United States Patent [19]

Rasmussen et al.

[11] Patent Number: 4,511,874

[45] Date of Patent: Apr. 16, 1985

[54] FATIGUE-RESISTANT FUSE STRIP

[75] Inventors: John F. Rasmussen, North Andover, Mass.; Aldino J. Gaia, St. Louis, Mo.

[73] Assignee: McGraw-Edison Company, Rolling Meadows, Ill.

[21] Appl. No.: 480,766

[22] Filed: Mar. 31, 1983

[51] Int. Cl.[3] ..... H01H 85/04

[52] U.S. Cl. ..... 337/159; 337/295

[58] Field of Search ..... 337/295, 159, 160

[56] References Cited

FOREIGN PATENT DOCUMENTS 1184408 12/1964 Fed. Rep. of Germany ..... 337/160

*Primary Examiner*—Harold Broome

*Attorney, Agent, or Firm*—John S. Paniaguas; Charles W. MacKinnon; Jon Carl Gealow

[57] ABSTRACT

An electrical fuse comprises a fusible ribbon having one or more weak spots along its axial length which is highly resistant to mechanical fatigue caused by cyclic heating and cooling of the fusible ribbon. The weak spot comprises a series of apertures arranged in a curvilinear or angular configuration extending transversely to the axis of the fuse ribbon between the opposite sides thereof. Centers of adjacent apertures of the series are offset from each other with respect to the axis of the fusible ribbon by a distance at least equal to the shortest distance between the geometric center and the peripheral edge of any one of the adjacent apertures such that the cross-sectional area of the weak spot is distributed transversely across the fuse ribbon.

20 Claims, 7 Drawing Figures

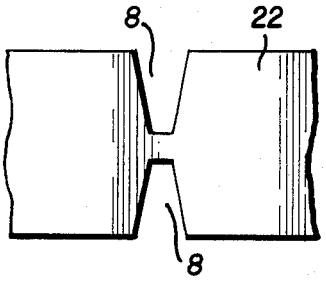
FIG. 1A
(PRIOR ART)
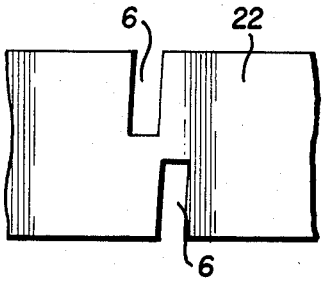
FIG. 1B
(PRIOR ART)
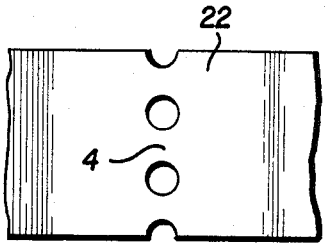
FIG. 1C
(PRIOR ART)
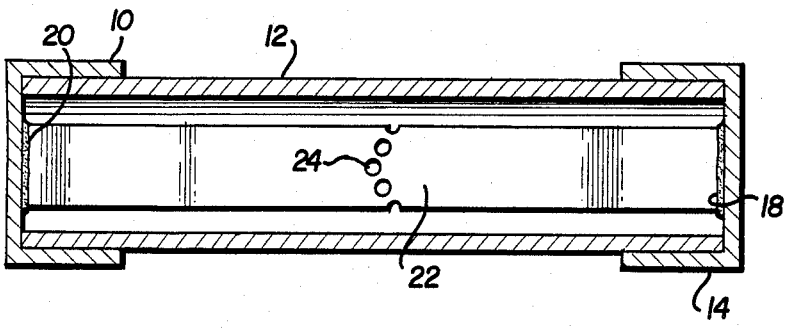
FIG. 2
FIG. 3
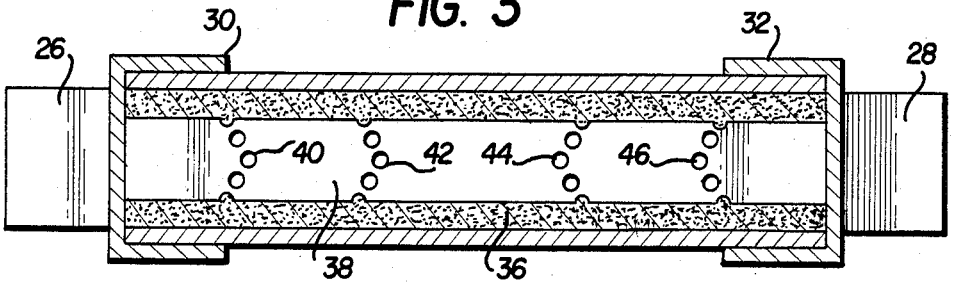
FIG. 4
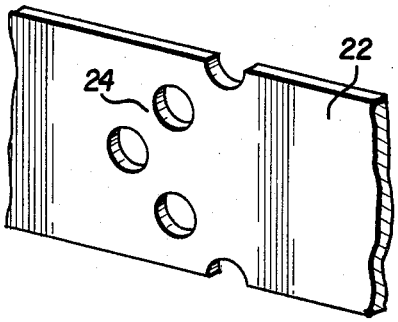
FIG. 5
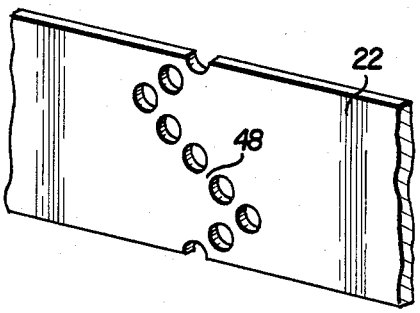

FATIGUE-RESISTANT FUSE STRIP

BACKGROUND OF THE INVENTION

This invention relates to fusible elements for use in electric circuits and more particularly to fusible elements having improved fatigue-resistance when subjected to cyclic loads.

Most prior art fusible elements or fusible ribbons for electric fuses have one or more portions thereof of reduced cross-sectional area which are known as "weak spots". Due to the fact that the weak spots in the fusible ribbons have reduced cross-sectional area, they have a higher ohmic resistance per unit length than the non-weak spot portions of the fusible ribbons. Consequently, at any given current load the heat build-up per unit length is greatest at the weak spot, and the weak spot is the first portion of the fusible ribbon to fuse during a severe overcurrent.

Although weak spots in fusible ribbons take many forms in the prior art, it is common for a weak spot or spots to be linearly arranged transversely to the axis of the fuse ribbon. Since a weak spot has a reduced cross-section compared with the remainder of the fusible ribbon, they represent, mechanically, the weakest sections of the fusible ribbon. Under conditions of cyclic loading, e.g. frequent on-off cycles of current flow, the fuse element or ribbon heats and cools cyclically causing mechanical stress therein due to cyclical expansion and contraction. A weak spot, having the least mechanical strength, is flexed and stressed more than the remainder of the element. The largest heat build-up per unit length of the fusible ribbon also occurs at weak spots causing stress therein due to this expansion. This leads to fatigue in the metal at weak spots and frequently will ultimately lead to fuse failure due to mechanical failure of a weak spot.

SUMMARY OF THE INVENTION

The present invention provides improved resistance to fatigue and ultimate mechanical failure at the weak spots of a fusible element even under the most severe cyclic loading. By providing weak spots in the form of a plurality of apertures or holes, preferably circular, arranged in a curvilinear or angular configuration extending transversely to the axis of the fuse ribbon, the reduction in cross-sectional area at any given linear transverse path on the fuse ribbon is minimized. Each weak spot is characterized as having minimized the cross-sectional area reduction at any single section along the element and as having extended the lateral distribution of the reduction. The areas of heat build-up are thereby distributed transversely across the fuse ribbon rather than being concentrated in a small linear area.

A weak spot in accordance with the present invention comprises a series of apertures or holes in the fuse ribbon with the geometric centers of the apertures aligned along a curved or angular path extending transverse to the axis of the fuse ribbon between the opposite edges thereof such that the apertures are axially offset with respect to each other. The apertures are arranged such that any two adjacent apertures of the series are offset from each other with respect to the transverse axis of the fusible ribbon by a distance at least equal to the shortest distance between the geometric center and the peripheral edge of any one of the two adjacent apertures. Preferably, the centers of adjacent apertures are offset from each other by a distance ranging from said shortest distance between the geometric center and peripheral edge of any one of the two adjacent apertures to a distance equal to the shortest distance from one peripheral edge to the opposite peripheral edge through the geometric center of any one of the two adjacent apertures.

An object of the present invention is to provide a fuse element that is highly resistant to mechanical fatigue.

A further object of the invention is to provide a fusible element for use in fuses subjected to cyclic loading.

A still further object of the invention is to provide a fuse element having one or more weak spots with improved mechanical strength.

Other objects, features and advantages of the present invention will become apparent with reference to the accompanying drawings and description.

BRIEF DESCRIPTION OF THE DRAWINGS

FIGS. 1A, 1B and 1C are fragmentary views of prior art fusible ribbons containing weak spots;

FIG. 2 is a cross-sectional view of a low voltage fuse containing a preferred embodiment of a fusible ribbon in accordance with the present invention;

FIG. 3 is a cross-sectional view of a high voltage fuse containing another preferred embodiment of a fusible ribbon in accordance with the present invention;

FIG. 4 is an enlarged fragmentary perspective view of the fusible ribbon of the fuse illustrated in FIG. 2; and FIG. 5 is a fragmentary perspective view of a still further preferred embodiment of a fusible ribbon in accordance with the present invention.

DETAILED DESCRIPTION OF THE INVENTION

As stated above, the prior art discloses numerous configurations for weak spots in fuse ribbons. Features and advantages of the present invention can be better understood by first examining examples of weak spot configurations in prior art fusible ribbons. FIG. 1A illustrates a common weak spot configuration comprising notches 8 cut into opposite edges of fusible ribbon 22 such that they are aligned. The reduced cross-sectional area of the weak spot presents the bulk of the resistance of the fuse ribbon. It is readily apparent that the weak spot is mechanically the weakest area of the fusible ribbon and that under thermal expansion the stress in this weak area will cause the area to flex before the remainder of the fusible ribbon flexes. This flexing during the cyclical application of electrical current causes fatigue at the weak spot and may eventually result in mechanical failure of the weak spot.

FIG. 1B shows another form of prior art weak spot in a fusible ribbon. The rectangular notches 6 cut into opposite edges of the fuse ribbon are axially offset. This type of weak spot is disclosed in U.S. Pat. No. 3,417,357 to Withers and assigned to the assignee of the present invention. The effective length of the weak spot disclosed in the Withers patent is zero due to the fact that, as viewed in FIG. 1B, the right edge of the upper notch is aligned with the left edge of the lower notch. This weak spot is also a mechanically weak point in the fuse ribbon and is subject to mechanical failure due to cyclical loading.

FIG. 1C illustrates still another form of prior art weak spot as disclosed, for example, in U.S. Pat. No. 2,858,396 to Sugden, U.S. Pat. No. 3,123,694 to Kozacka and U.S. Pat. No. 1,396,255 to Conner and in U.S. Pat. No. 4,041,435 to Gaia and assigned to the assignee to the present invention. Weak spot 4 comprises a set of circular apertures in the fusible ribbon 22 arranged in a linear configuration perpendicular to the axis of the fusible ribbon. It can be readily seen that this type of weak spot also forms the line of maximum mechanical stress in the fusible ribbon during expansion due to heating. Under cyclic loading the repeated thermal expansion and contraction of the fusible ribbon will stress the weak spot and probably cause eventual mechanical failure.

FIG. 2 illustrates a fuse designed for low voltage use comprising a fusible ribbon 22 in accordance with the present invention. Opposite ends of fusible ribbon 22 are secured to ferrules 10 and 14 by solder connections 18 and 20. Ferrules 10 and 14 are telescoped over the opposite ends of insulated cylindrical shell 12. The weak spot in fusible ribbon 22 comprises a plurality of circular apertures 24 arranged transversely across the fuse ribbon in an angular, V-shaped or C-shaped configuration. A higher current weak spot is shown in enlarged detail in FIG. 4. In fusible ribbon 22, as shown in FIG. 2, the apertures which are of common diameter, are arranged such that the centers of adjacent apertures are offset from each other, with respect to the transverse axis of the fuse ribbon, by at least a distance equal to the radii of the apertures.

The configuration of apertures 24 shown in FIG. 2 provides a weak spot in which the reduction in cross-sectional area at any single transverse section along the element has been minimized and the lateral distribution of the cross-sectional area reduction has been extended. Under an overcurrent condition, the current density in the weak area will rise to a sufficient level to cause the element to fuse between circular apertures 24 thus providing the desired clearing action. Mechanical stress due to thermal expansion is distributed over the lateral extent of the weak spot area effectively reducing the stress at any linear transverse section compared with the stress produced in weak spots of prior art fusible ribbons. The embodiment of the present invention, as illustrated in FIGS. 2 and 4, constitutes a distributed weak spot in which the mechanical characteristics of the weak spot are distributed laterally along a portion of the length of the fuse ribbon rather than being laterally concentrated as taught in the prior art.

FIG. 3 illustrates a fuse designed for high voltage use comprising another embodiment of a fuse ribbon in accordance with the present invention. The high voltage fuse comprises terminals 26 and 28, ferrules 30 and 32, insulated cylindrical shell 34, arc quenching material 36 and fuse ribbon 38 having a plurality of weak spots 40, 42, 44 and 46, each comprising a plurality of circular apertures of equal diameter arranged transversely across the fuse ribbon in an angular or V-shaped configuration. The apertures of each weak spot are arranged in substantially the same configuration as in the embodiment illustrated in FIG. 2. The centers of adjacent apertures are offset from each other, with respect to the transverse axis of the fusible ribbon, by a distance equal to the radii of the apertures.

An alternative embodiment of the laterally distributed weak spot of the present invention is illustrated in FIG. 5. The weak spot comprises a plurality of circular apertures 48 arranged in a generally Z-shaped configuration extending transversely to the axis of fusible ribbon 22. The Z-shaped laterally distributed weak spot provides a means to distribute mechanical stress laterally in fusible ribbon 22 and thereby provide fatigue resistance for the fusible element.

The plurality of apertures constituting a weak spot in accordance with the present invention are preferably of substantially equal diameter. However, they may be of unequal diameter without departing from the spirit of the present invention. In this instance the plurality of apertures of a weak spot are arranged such that the centers of any two adjacent apertures are offset from each other with respect to the transverse axis of the fuse ribbon by a distance at least equal to the radius of either of the apertures. The apertures may be shaped in other than circular form without departing from the spirit of the present invention. In this instance the center of any two adjacent apertures are offset from each other with respect to the axis of the fusible ribbon by a distance at least equal to the shortest distance between the geometric center and the peripheral edge of either of the apertures.

In each of the aperture configurations herein described, those apertures nearest the opposite edges are located so that their geometric centers are substantially colinear with respect to the transverse axis of the fuse. Additionally, apertures may be located at opposite edges of the fuse ribbon with their geometric centers disposed along the edges of the fuse ribbon thereby forming notches along the edges.

The embodiments of the present invention as described hereinabove present the preferred embodiments of the invention. However, it is to be understood that changes and modifications thereto are within the intent and spirit of the present invention.

What is claimed is:

1. An electrical fuse comprising a fusible ribbon having at least one weak spot along its axial length which is resistant to mechanical fatigue, said weak spot of said fusible ribbon comprising a series of apertures having geometric centers arranged in a curvilinear or angular configuration which extends transversely to said axis of said fusible ribbon between opposite edges thereof, wherein the geometric centers of said apertures nearest the opposite edges are substantially colinear with respect to the transverse axis of the fusible ribbon and wherein the geometric centers of adjacent apertures of said series of apertures are offset from each other with respect to the transverse axis of said fusible ribbon by a distance at least equal to the shortest distance between the geometric center and the peripheral edge of any one of said adjacent apertures, whereby the cross-sectional area of said weak spot is distributed transversely across said fusible ribbon.

2. An electrical fuse according to claim 1 wherein said apertures are of uniform configuration and size.

3. An electrical fuse according to claim 1 wherein said apertures are circular.

4. An electrical fuse according to claim 3 wherein said circular apertures are of equal diameter.

5. An electrical fuse according to claim 3, wherein the centers of adjacent apertures of said series of apertures are offset from each other with respect to the transverse axis of said fusible ribbon by a distance not greater than the diameter of any one of said adjacent apertures.

6. An electrical fuse according to claim 1, wherein the geometric centers of adjacent apertures of said series of apertures are offset from each other with respect to the transverse axis of said fusible ribbon by a distance not greater than the shortest distance between the geometric center and a peripheral edge of any one of said adjacent apertures.

7. An electrical fuse according to claim 1 wherein said series of apertures are arranged in a V-shaped configuration.

8. An electrical fuse according to claim 1 wherein said series of apertures are arranged in a Z-shaped configuration.

9. An additional fuse according to claim 1 wherein said series of apertures are arranged in a C-shaped configuration.

10. A fuse ribbon for use in an electrical fuse having at least one weak spot along its axial length which is resistant to mechanical fatigue, said weak spot of said fusible ribbon comprising a series of apertures having geometric centers arranged in a curvilinear or angular figuration which extends transversely to said axis of said fuse ribbon between opposite sides thereof, wherein the geometric centers of said apertures nearest the opposite edges are substantially colinear with respect to the transverse axis of the fuse ribbon and wherein the geometric centers of adjacent apertures of said series of apertures are offset with each other with respect to said axis of said fusible ribbon by a distance at least equal to the shortest distance between the geometric center and the peripheral edge of any one of said adjacent apertures, whereby the cross-sectional area of said weak spot is distributed transversely across said fusible ribbon.

11. A fusible ribbon according to claim 10 wherein said apertures are of uniform configuration and size.

12. A fusible ribbon according to claim 10 wherein said apertures are circular.

13. A fusible ribbon according to claim 12 wherein said circular apertures are of equal diameter.

14. A fusible ribbon according to claim 10, wherein the geometric centers of adjacent apertures of said series of apertures are offset from each other with respect to the transverse axis of said fusible ribbon by a distance not greater than the shortest distance from one peripheral edge to the opposite peripheral edge through the geometric center of any one of the adjacent apertures.

15. A fusible ribbon according to claim 12 wherein adjacent apertures of said series are offset from each other with respect to the transverse axis of said fusible ribbon by a distance not greater than the diameter of any one of said adjacent apertures.

16. A fusible ribbon according to claim 10 wherein said series of apertures are arranged in a V-shaped configuration.

17. A fusible ribbon according to claim 10 wherein said series of apertures are arranged in a Z-shaped configuration.

18. A fusible ribbon according to claim 10 wherein said series of apertures are arranged in a C-shaped configuration.

19. An electrical fuse comprising a fusible ribbon having at least one weak spot along the axial length which is resistant to mechanical fatigue, said weak spot of said fusible ribbon comprising a series of apertures having geometric centers arranged in a curvilinear or angular configuration which extends transversely to said axis of said fusible ribbon between opposite edges thereof and wherein the locus of geometric centers of said apertures define at least one angle, and further having the geometric centers of apertures of said series of apertures being offset from each other with respect to the transverse axis of said fusible ribbon by a distance at least equal to the shortest distance between the geometric center and the peripheral edge of any one of said adjacent apertures, whereby the cross-sectional area of said weak spot is distributed transversely across said fusible ribbon.

20. An electrical fuse according to claim 19 wherein the geometric centers of adjacent apertures of said series of apertures are offset from each other with respect to the transverse axis of said fusible ribbon by a distance not greater than the distance between opposite peripheral edges of an adjacent aperture.

* * * * *